US010627186B2

(12) United States Patent
Chang

(10) Patent No.: US 10,627,186 B2
(45) Date of Patent: Apr. 21, 2020

(54) CROSSBOW WITH BELLEVILLE SPRINGS

(71) Applicant: Ko-Yu Chang, Taichung (TW)

(72) Inventor: Ko-Yu Chang, Taichung (TW)

( * ) Notice: Subject to any disclaimer, the term of this patent is extended or adjusted under 35 U.S.C. 154(b) by 0 days.

(21) Appl. No.: 16/392,703

(22) Filed: Apr. 24, 2019

(65) Prior Publication Data

US 2020/0011633 A1 Jan. 9, 2020

(30) Foreign Application Priority Data

Jul. 3, 2018 (TW) ..... 107122998 A

(51) Int. Cl.
*F41B 5/12* (2006.01)

(52) U.S. Cl.
CPC ..... *F41B 5/123* (2013.01)

(58) Field of Classification Search
CPC ..... F41B 5/10; F41B 5/123
See application file for complete search history.

(56) References Cited

U.S. PATENT DOCUMENTS 5,454,361 A * 10/1995 Bronnert ..... F41B 5/0005 124/23.1
6,019,097 A * 2/2000 Cox ..... F41B 5/0026 124/23.1
7,832,387 B1 * 11/2010 Yehle ..... F41B 5/10 124/23.1
8,522,763 B2 * 9/2013 Nebergall ..... F41B 5/10 124/25.6
8,789,520 B2 * 7/2014 Nebergall ..... F41B 5/10 124/25.6
9,086,249 B2 * 7/2015 Peacemaker ..... F41B 5/10
9,255,756 B1 2/2016 Wu et al.
2010/0000504 A1 1/2010 Trpkovski

FOREIGN PATENT DOCUMENTS

CN 107305109 A 10/2017

* cited by examiner

*Primary Examiner* — John A Ricci
(74) *Attorney, Agent, or Firm* — Alan D. Kamrath; Karin L. Williams; Mayer & Williams PC

(57) ABSTRACT

A crossbow has a body, two bow assemblies, two pulley assemblies, and a string. The two bow assemblies are respectively disposed at two sides of the body. Each one of the two bow assemblies has a limb being capable of swinging relative to the body, a guiding unit obliquely extending toward the limb, a joint with two ends, and multiple Belleville springs mounted on and around the guiding unit and simultaneously abutting against the body and the joint. An angle is defined between the guiding unit and the body. The joint has an allowance for movement with the limb that allows a free end of the limb to be pulled toward the body. The two pulley assemblies are respectively mounted on two free ends of two limbs of the two bow assemblies. The string has two ends respectively fixed to the two pulley assemblies.

15 Claims, 7 Drawing Sheets

CROSSBOW WITH BELLEVILLE SPRINGS

BACKGROUND OF THE INVENTION

1. Field of the Invention

The present invention relates to a crossbow, and more particularly to a crossbow that has Belleville springs to prolong the useful life of the crossbow.

2. Description of Related Art

With reference to FIG. 6, a conventional crossbow comprises a body 60, a first limb 70A, a second limb 70B, a first pulley assembly 80A, a second pulley assembly 80B, and a string 90. The first limb 70A and the second limb 70B are connected with the body 60. The first pulley assembly 80A is mounted on the first limb 70A and comprises a first pulley 81A and a first cable 82A. The first pulley 81A is mounted rotatably on a free end of the first limb 70A. The first cable 82A is mounted around the first pulley 81A and is connected securely with the second limb 70B. The second pulley assembly 80B is mounted on the second limb 70B and comprises a second pulley 81B and a second cable 82B. The second pulley 81B is mounted rotatably on a free end of the second limb 70B. The second cable 82A is mounted around the second pulley 81B and is connected securely with the first limb 70A. The string 90 is mounted around the first pulley 81A and the second pulley 81B and has two ends connected respectively with the first pulley 81A and the second pulley 81B.

With reference further to FIG. 7, when the string 90 is pulled, the first pulley 81A and the second pulley 81B are driven to rotate by the string 90. The first cable 82A and the second cable 82B are partially rolled around the first pulley 81A and the second pulley 81B, and the free ends of the first and second limbs 70A, 70B are bent toward the body 60. Because the first cable 82A and the second cable 82B are connected securely with the first limb 70A and the second limb 70B respectively, the rolled length of the cables 82, 82B onto the pulleys 781A, 81B will determine the bent degrees of the limbs 70A, 70B. The limbs 70A, 70B may be overly bent in each operation of the crossbow, such that the limbs 70A, 70B easily elastically fatigue. Therefore, the useful life of the crossbow will be shortened.

To overcome the shortcomings of the conventional crossbow, the present invention provides a crossbow with Belleville springs to mitigate or obviate the aforementioned problems.

SUMMARY OF THE INVENTION

The main objective of the present invention is to provide a crossbow with Belleville springs to prolong the useful life of the crossbow.

The crossbow comprises a body, two bow assemblies, two pulley assemblies, and a string. The two bow assemblies are respectively disposed at two sides of the body. Each one of the two bow assemblies has a limb being capable of swinging relative to the body, a guiding unit obliquely extending toward the limb, a joint with two ends, and multiple Belleville springs mounted on and around the guiding unit and simultaneously abutting against the body and the joint. An angle is defined between the guiding unit and the body. The joint has an allowance for movement with the limb that allows a free end of the limb to be pulled toward the body. The two pulley assemblies are respectively mounted on two free ends of two limbs of the two bow assemblies. The string has two ends respectively fixed to the two pulley assemblies.

Other objects, advantages, and novel features of the invention will become more apparent from the following detailed description when taken in conjunction with the accompanying drawings.

DETAILED DESCRIPTION OF PREFERRED EMBODIMENTS

Figure 1:
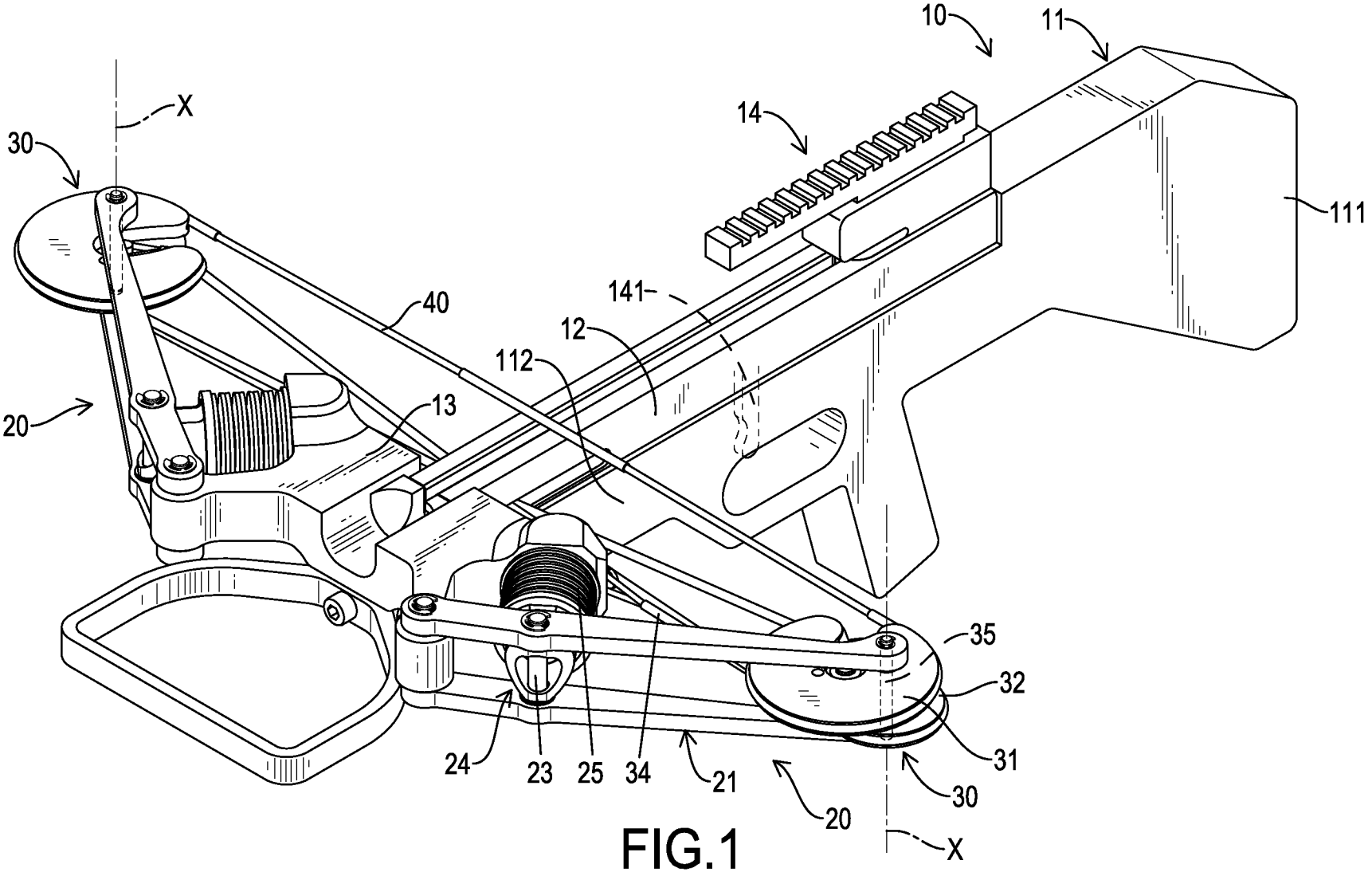
FIG. 1 is a perspective view of a crossbow in accordance with the present invention.

With reference to FIG. 1, a crossbow in accordance with the present invention has a body 10, two bow assemblies 20, two pulley assemblies 30, and a string 40. The two bow assemblies 20 are mounted to the body 10. The two pulley assemblies 30 are respectively connected to the two bow assemblies 20. The string 40 is mounted on the two pulley assemblies 30.

With reference to FIG. 1, the body 10 has an extending direction, a lateral direction, a longitudinal direction, a front end, a rear end, two sides, a holding segment 11, an arrow mount 12, a bow mount 13, and a trigger assembly 14. The extending direction, the lateral direction, and the longitudinal direction are perpendicular to one another. The two sides of the body are opposite in the lateral direction of the body 10. The holding segment 11 has a buttstock 111 and a front grip 112. The buttstock 111 is formed on the rear end of the body 10. The front grip 112 is integrally connected with the buttstock 111 and extends along the extending direction of the body 10. The arrow mount 12 is connected to the holding segment 11 for receiving arrows. The arrow mount 12 extends along the extending direction of the body 10 and toward the front end of the body 10. The bow mount 13 is disposed at the front end of the body 10 and is connected to the arrow mount 12. The trigger assembly 14 is connected to the arrow mount 12 and has a trigger 141 mounted through the holding segment 11.

In the embodiment, the buttstock 111 and the front grip 112 of the holding segment 11 are integrally connected with each other, and the holding segment 11 and the arrow mount 12 are two independent components connected to each other. Practically, the buttstock 111 and the front grip 112 may be implemented as two independent components detachably connected to each other or may be formed as an integral component. The combination manner of the holding segment 11, the arrow mount 12, the buttstock 111, and the front grip 112 is not limited in the present invention.

Figure 2:
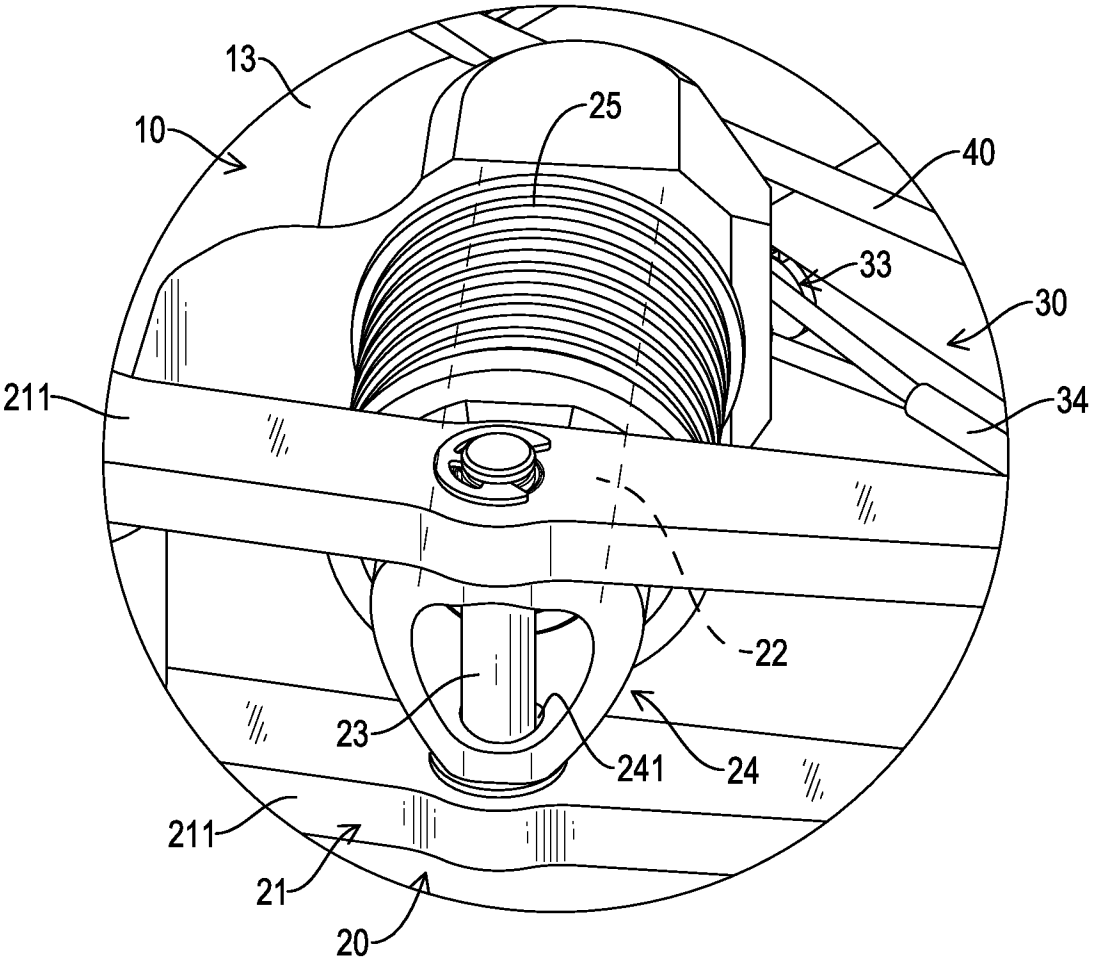
FIG. 2 is an enlarged perspective view of Belleville springs of the crossbow in FIG. 1.
Figure 3:
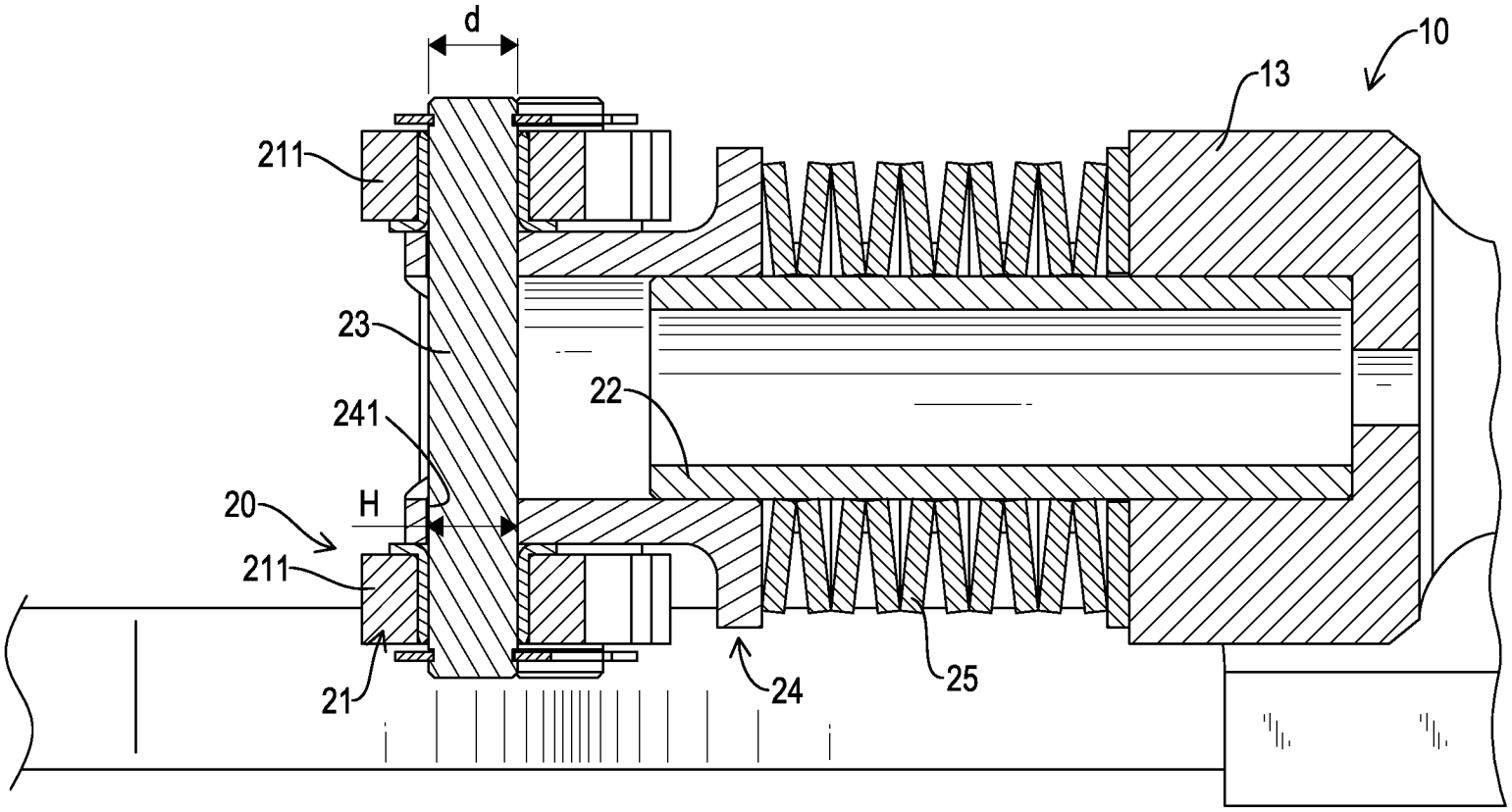
FIG. 3 is an enlarged side view in partial section of the crossbow in FIG. 1.
Figures 4, 4A:
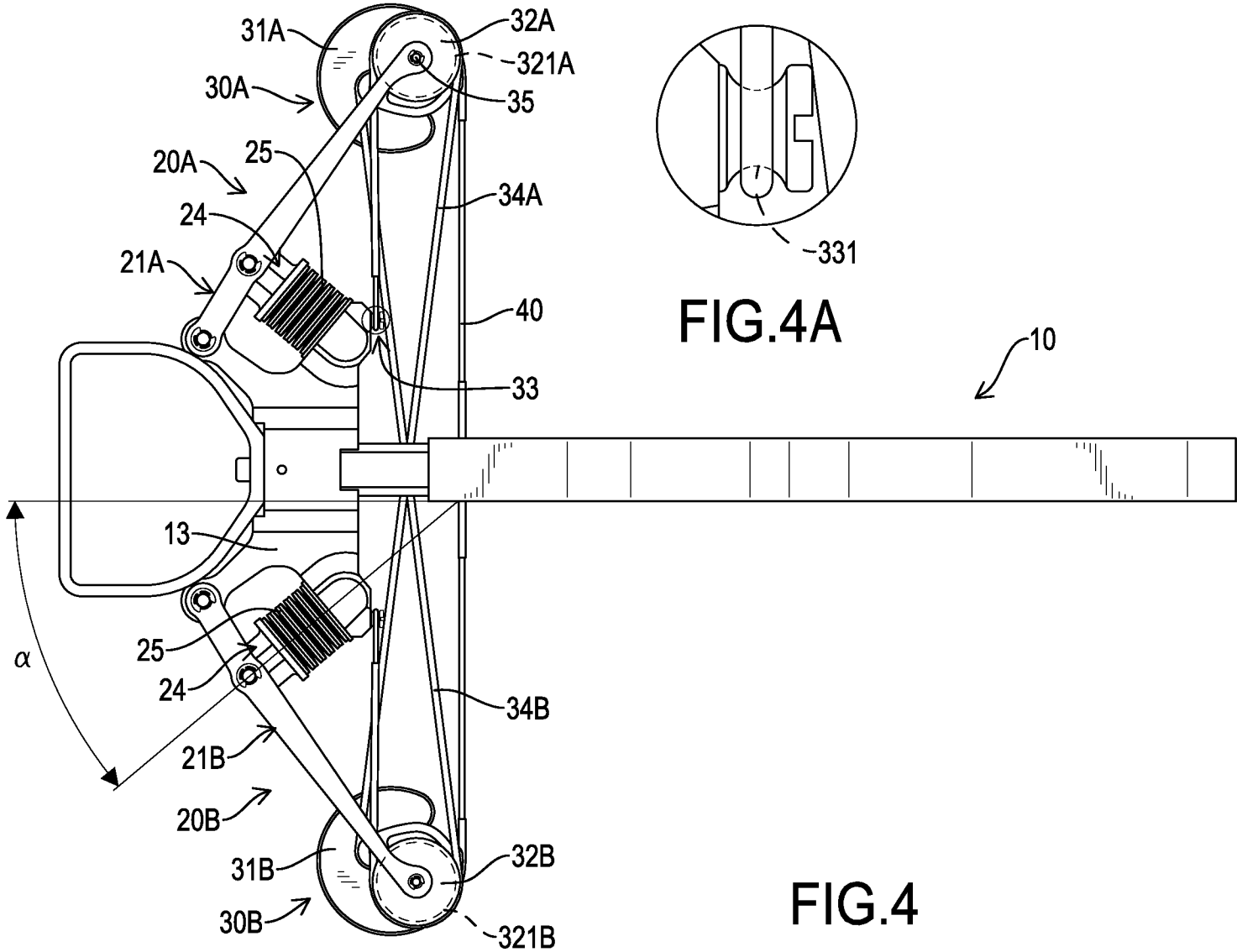
FIG. 4 is a bottom view of the crossbow in FIG. 1.
FIG. 4A is an enlarged bottom view of the cable mount of the crossbow in FIG. 4.

With reference to FIGS. 1 to 3, the two bow assemblies 20 are respectively disposed at the two sides of the body 10. Each one of the two bow assemblies 20 has a limb 21, a guiding unit 22, a pivoting shaft 23, a joint 24, and multiple Belleville springs 25. The limb 21 is a rigid component that is hard to be bent. The limb 21 is connected to the front end of the body 10, is capable of swinging relative to the body 10, and has a free end disposed away from the body 10. The guiding unit 22 has two opposite ends. One of the two opposite ends of the guiding unit 22 is fixed to the bow mount 13. The guiding unit 22 obliquely extends from the bow mount 13 of the body 10 toward the limb 21 of the bow assembly 20 and has an extending direction. An angle $\alpha$ is defined between the extending directions of the guiding unit 22 and the body 10 as shown in FIG. 4. The pivoting shaft 23 is fixed to the limb 21 of the bow assembly 20 and is parallel to the longitudinal direction of the body 10. The pivoting shaft 23 has a diameter d. The joint 24 has two opposite ends and a pivoting hole 241. The pivoting hole 241 is formed at one of the two ends of the joint 24, is disposed on and around the pivoting shaft 23, and has a diameter H being larger than the diameter d of the pivoting shaft 23. The joint 24 is capable of swinging relative to the limb 21 via the pivoting hole 241. The other one of the two opposite ends of the joint 24 is slidably mounted on and around the guiding unit 22. Since the diameter H of the pivoting hole 241 is larger than the diameter d of the pivoting shaft 23, the joint 24 has an allowance for movement relative to the limb 21. The multiple Belleville springs 25 are mounted on and around the guiding unit 22 and simultaneously abutting against the body 10 and the joint 24.

In the embodiment, the two limbs 21 are two independent components and are respectively connected to the bow mount 13. Each one of the two limbs 21 has two limb units 211. Alternatively, each one of the two limbs 21 may be a single component. Type of each limb 21 is not limited in the present invention. In addition, the guiding unit 22 is fixed to the bow mount 13 of the body 10. Practically, the two guiding units 22 may be integrated with the bow mount 13 as a single component or may be connected to the holding segment 11 of the body 10. Positions and assemblies of the two guiding units 22 are not limited in the present invention. In the embodiment of the present invention, since the diameter H of the pivoting hole 241 of each joint 24 is larger than the diameter d of the pivoting shaft 23 of the bow assembly 20, the joint 24 is provided with the allowance for movement relative to the limb 21 of the bow assembly.

With reference to FIGS. 1 and 4, in the embodiment, the bow mount 13 is disposed at the front end of the body 10, and the two free ends of the two limbs 21 extend toward the rear end of the body 10. Practically, the bow mount 13 may be disposed at a middle portion of the body 10 or even disposed at a position adjacent to the rear end of the body 10. The position where the bow mount 13 is disposed at the body 10 is not limited in the present invention.

With reference to FIGS. 1 and 2, the two pulley assemblies 30 are respectively connected at the two free ends of the two limbs 21. Each one of the two pulley assemblies 30 has a string pulley 31, an idle wheel 32, a cable mount 33, and a cable 34. The string pulley 31 is an eccentric cam and is rotatably connected to a corresponding one of the two limbs 21. The string pulley 31 is capable of rotating along an axis X parallel to the longitudinal direction of the body 10. The idle wheel 32 is rotatably connected to the corresponding limb 21 and has a cable tray being annular. The idle wheel 32 is capable of rotating along an axis X parallel to the longitudinal direction of the body 10. In the embodiment, each one of the two pulley assemblies 30 has a spinning shaft 35 extending along the axis X. The string pulley 31 and the idle wheel 32 of the pulley assembly 30 are rotatably connected to a corresponding one of the two limbs 21.

With further reference to FIG. 4, the cable mount 33 is mounted on a side of the bow mount 13 facing to the rear end of the body 10, and has an annular groove 331. The cable 34 has two opposite ends. One of the two opposite ends of the cable 34 of each one of the two pulley assemblies 30 is mounted in and around the annular groove 331 of the cable mount 33 of the pulley assembly 30. The other one of the two opposite ends of the cable 34 of each one of the two pulley assemblies 30 is connected to the string pulley 31 of the other one of the two pulley assemblies 30. The cable 34 of each one of the two pulley assemblies 30 surrounds the idle wheel 32 of the pulley assembly 30 and the string pulley 31 of the other one of the two pulley assemblies 30.

With reference to FIG. 1, the string 40 has two opposite ends. The string 40 extends around the two string pulleys 31 of the two pulley assemblies 30. The two opposite ends of the string 40 are respectively fixed to the two string pulleys 31.

With reference to FIG. 4, for concision of description, the two bow assemblies are distinguished into a first bow assemblies 20A and a second bow assemblies 20B. The two limbs 21 are further distinguished into a first limb 21A and a second limb 21B. The two pulley assemblies 30 are distinguished into a first pulley assemblies 30A connected to the first limb 21A and a second pulley assemblies 30B connected to the second limb 21B. The first pulley assembly 30A and the second pulley assembly 30B respectively have the string pulley 31A, 31B, the idle wheel 32A, 32B, and the cable 34A, 34B. Each one of the two idle wheels 32A, 32B has the cable tray 321A, 321B being annular.

Wherein, the cable 34A of the first pulley assembly 30A extends from the front end of the body 10 and extends toward the free end of the first limb 21A. The cable 34A extends around the idle wheel 32A of the first pulley assembly 30 and extends toward the free end of the second limb 21B. Then the cable 34A extends around the string pulley 31B of the second pulley assembly 30B and is fixed to the string pulley 31B. Similarly, the cable 34B of the second pulley assembly 30B extends from the front end of the body 10, extends toward the free end of the second limb 21B, extends around the idle wheel 32B, extends toward the free end of the first limb 21A, extends around the string pulley 31A of the first pulley assembly 30A, and then is fixed to the string pulley 31A.

Figure 5:
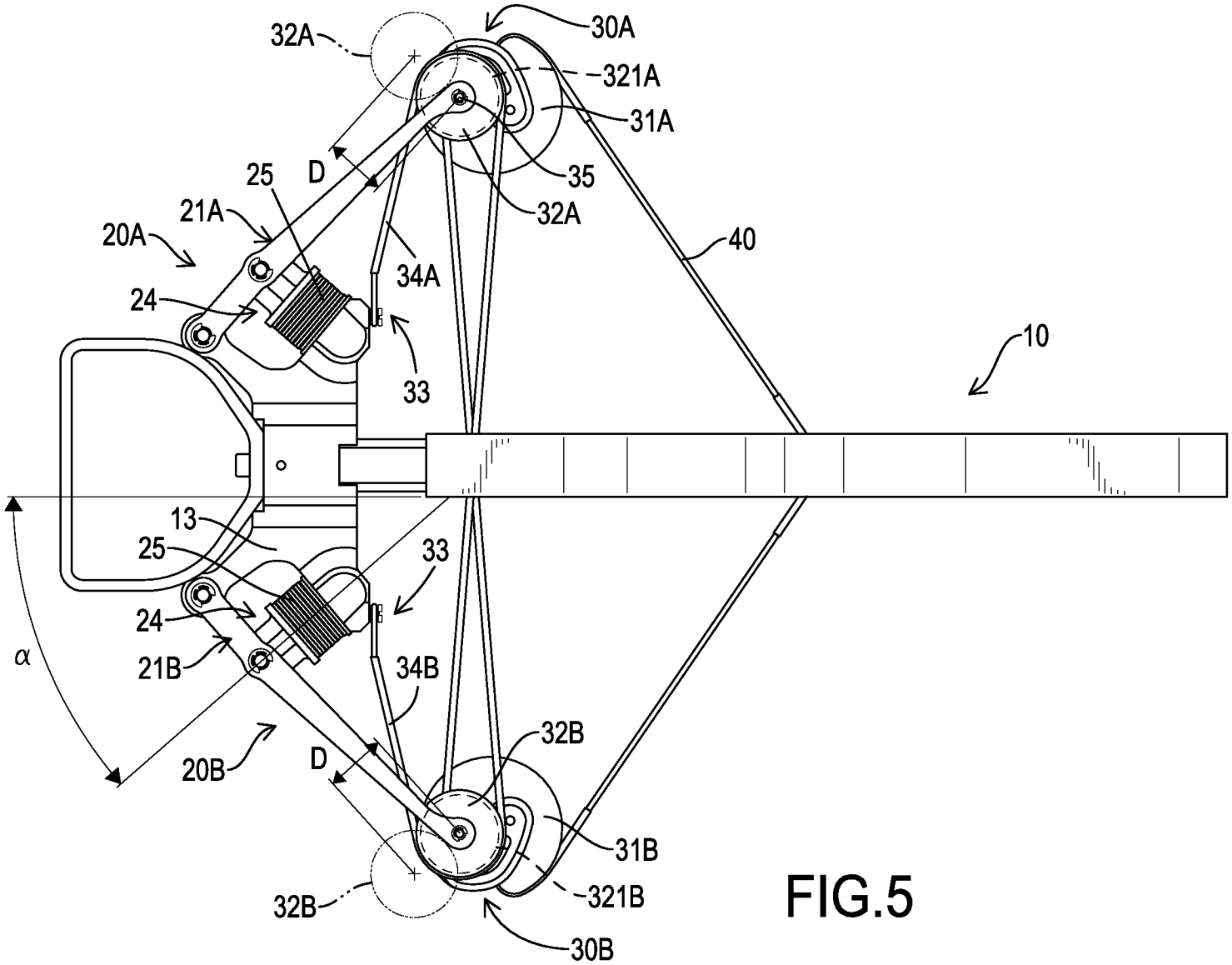
FIG. 5 is an operational bottom view of the crossbow in FIG. 1.
Figure 6:
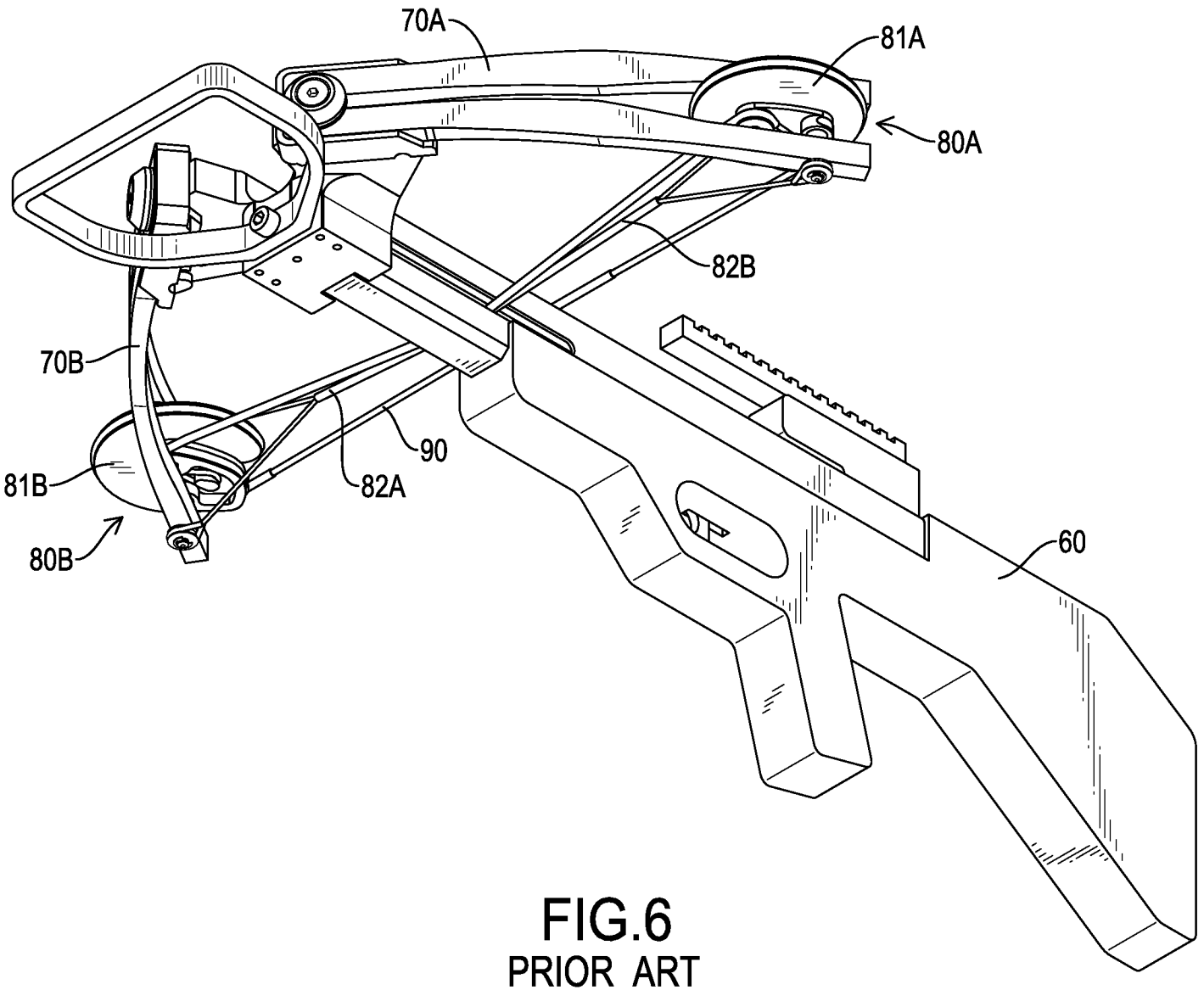
FIG.6 PRIOR ART
FIG. 6 is a perspective view of a conventional crossbow.
Figure 7:
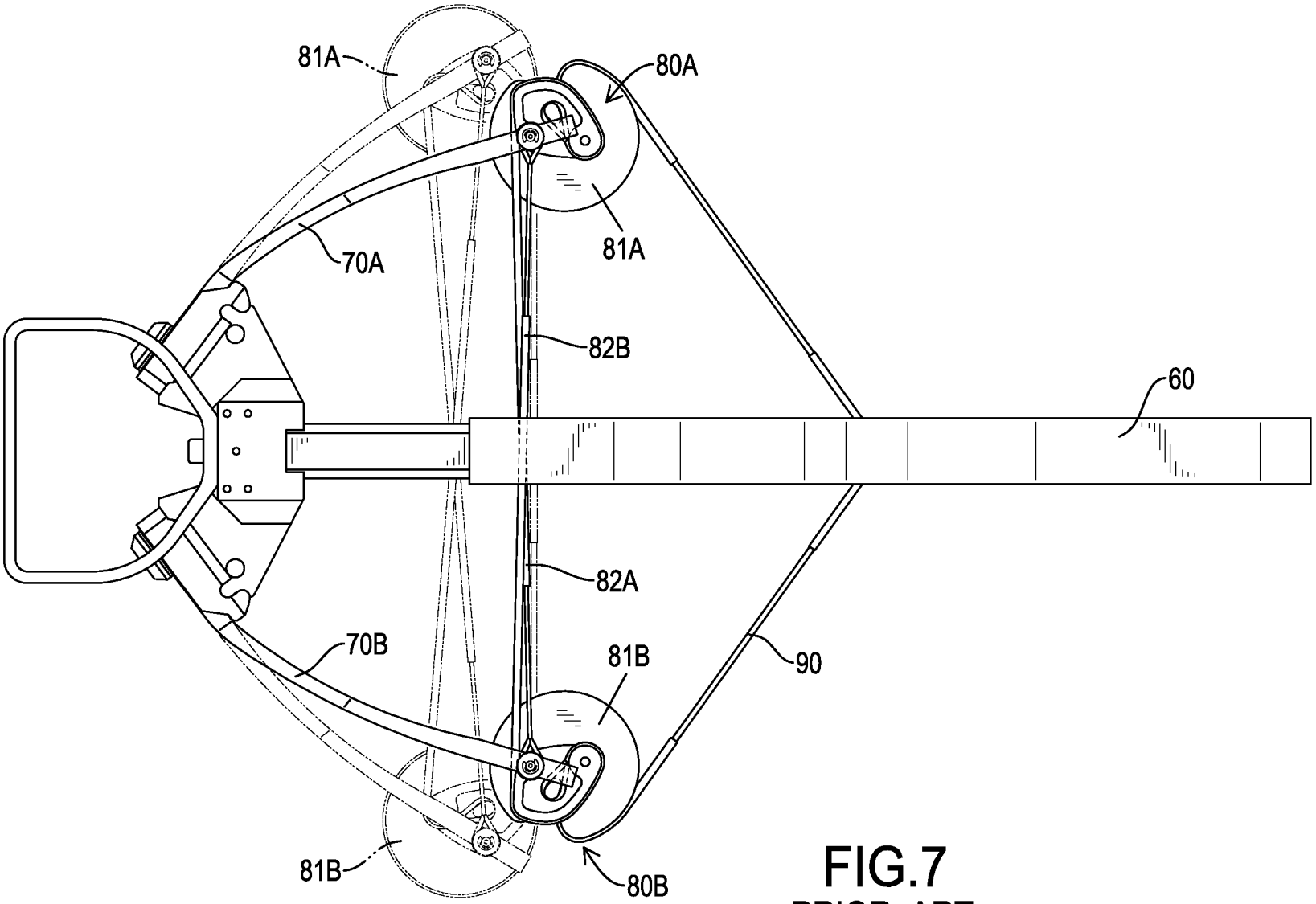
FIG.7 PRIOR ART
FIG. 7 is an operational bottom view of the conventional crossbow in FIG. 6.

With reference to FIGS. 4 and 5, the string 40 is subjected to a pulling force and is pulled toward the rear end of the body 10. The string 40 that extends around and is fixed to the two string pulleys 31A, 31B drives the two string pulleys 31A, 31B to rotate. The two string pulleys 31A, 31B wind up the two cables 34A, 34B that are respectively fixed to the two string pulleys 31A, 31B. Since the two cables 34A, 34B respectively extend around the two idle wheels 32A, 32B, the two cables 34A, 34B respectively pull the two idle wheels 32A, 32B to make the two idle wheels 32A, 32B move toward the body 10. Since the first and second limbs 21A, 21B are capable of swinging relative to the body 10, the multiple Belleville springs 25 are compressible, and the two joints 24 respectively have the allowance for movement relative to the first and second limbs 21A, 21B. The two free ends of the first and second limbs 21A, 21B are capable of being pulled toward the body 10.

The two idle wheels 32A, 32B move toward the body 10 respectively by a moving distance D. The free ends of the first limb 21A and the second limb 21B are pulled and move toward the body 10 simultaneously. And the multiple Belleville springs 25 are compressed. In the present invention, the two idle wheels 32A, 32B of the first and second pulley assemblies 30A, 30B function as two movable pulleys and respectively shorten the two moving distances D of the two idle wheels 32A, 32B. The forces that the two limbs 21A, 21B are subjected to are reduced. When the string 40 is released, the Belleville springs 25 of the first and second bow assemblies 20A, 20B restore and respectively push the two joints 24 of the first and second bow assemblies 20A, 20B. The two joints 24 of the first and second bow assemblies 20A, 20B respectively slide along the two guiding units 22 of the first and second bow assemblies 20A, 20B and respectively abut against the first and second limbs 21A, 21B of the first and second bow assemblies 20A, 20B to shoot an arrow.

Compared to the conventional cross bow, the first and second limbs 21A, 21B of the first and the second bow assemblies 20A, 20B are pushed by the multiple Belleville springs 25 of the first and the second bow assemblies 20A, 20B. Therefore, the first and second limbs 21A, 21B of the first and the second bow assemblies 20A, 20B are capable of shooting the arrow without bending. Strains of the first and second limbs 21A, 21B are reduced. The useful lives of the first and second limbs 21A, 21B are prolonged. In addition, the multiple Belleville springs 25 are durable and are usually applied to be subjected to heavy loads in industrial. The durable Belleville springs 25 also can prolong the useful life of the cross bow in accordance with the present invention. When the string 40 is pulled toward the rear end of the body 10, the two idle wheels 32A, 32B can reduce the moving distances D of the two idle wheels 32A, 32B and can reduce the subjected forces of the first and second limbs 21A, 21B. Therefore, each of the first and second limbs 21A, 21B can be made of lightweight materials. Options of materials adopted to manufacture the bow mount 13 are flexible.

Finally, the diameter d of the pivoting hole 241 H of the joint 24 of each bow assembly 20A, 20B is larger than the diameter of the pivoting shaft 23. Each one of the joints 24 has an allowance for movement with a corresponding one of the first and second limbs 21A, 21B. And the first and second limbs 21A, 21B are capable of swinging relative to the body 10 and the multiple Belleville springs 25 are compressible. Therefore, the free ends of the first and second limbs 21A, 21B are capable of being pulled toward the body 10. The allowance for movement of each one of the joints 24 makes the first and second limbs 21A, 21B and the joint 24 capable of mutually swinging smoothly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A crossbow comprising:

a body having two sides;

two bow assemblies respectively disposed at the two sides of the body, and each one of the two bow assemblies comprising a limb connected to the body, capable of swinging relative to the body, and having a free end disposed away from the body;

a guiding unit obliquely extending from the body and toward the limb;

an angle defined between the guiding unit and the body;

a joint having two ends, wherein one of the two ends of the joint is slidably mounted on and around the guiding unit, and the other one of the two ends of the joint is connected to the limb, capable of swinging relative to the limb, and having an allowance for movement relative to the limb; and multiple Belleville springs mounted on and around the guiding unit and simultaneously abutting against the body and the joint;

two pulley assemblies respectively mounted on the two free ends of the two limbs of the two bow assemblies; and a string with two ends respectively fixed to the two pulley assemblies.

2. The crossbow as claimed in claim 1, wherein each one of the two bow assemblies has a pivoting shaft fixed to the limb of the bow assemblies and having a diameter; and the joint of each one of the two bow assemblies has a pivoting hole disposed on and around the pivoting shaft of the bow assembly and having a diameter larger than the diameter of the pivoting shaft.

3. The crossbow as claimed in claim 2, wherein each one of the two pulley assemblies has a string pulley rotatably mounted on the free end of a corresponding one of the two limbs;

an idle wheel rotatably mounted on the free end of the corresponding one of the two limbs; and a cable having two ends and wound around the string pulley and the idle wheel; and one of the two ends of the cable of each one of the two pulley assemblies is fixed to the body, and the other one of the two ends of the cable is fixed to the string pulley of the other one of the two pulley assemblies.

4. The crossbow as claimed in claim 3, wherein the idle wheel of each one of the two pulley assemblies has a cable tray being annular; and the cable of each one of the two pulley assemblies is mounted in the cable tray of the idle wheel of the pulley assembly.

5. The crossbow as claimed in claim 3, wherein the string pulley and the idle wheel of each one of the two pulley assemblies are coaxially disposed.

6. The crossbow as claimed in claim 3, wherein the body has a bow mount connected to the body;

each one of the two pulley assemblies has a cable mount connected to the bow mount; and the cable of each one of the two pulley assemblies is fixed to the cable mount of the pulley assembly and is fixed to the body via the cable mount of the pulley assembly.

7. The crossbow as claimed in claim 6, wherein the idle wheel of each one of the two pulley assemblies has a cable tray being annular; and the cable of each one of the pulley assemblies is mounted in the cable tray of the idle wheel of the pulley assembly.

8. The crossbow as claimed in claim 6, wherein the cable mount of each one of the two pulley assemblies has an annular groove; and the cable of each one of the two pulley assemblies is mounted in and around the annular groove of the cable mount of the pulley assembly.

9. The crossbow as claimed in claim 8, wherein the idle wheel of each one of the two pulley assemblies has a cable tray being annular; and the cable of each one of the two pulley assemblies is mounted in the cable tray of the idle wheel of the pulley assembly.

10. The crossbow as claimed in claim 8, wherein the string pulley and the idle wheel of each one of the two pulley assemblies are coaxially disposed.

11. The crossbow as claimed in claim 10, wherein the idle wheel of each one of the two pulley assemblies has a cable tray being annular; and the cable of each one of the two pulley assemblies is mounted in the cable tray of the idle wheel of the pulley assembly.

12. The crossbow as claimed in claim 10, wherein each one of the two pulley assemblies has a spinning shaft; and the string pulley and the idle wheel of each one of the pulley assemblies are mounted on and around the spinning shaft of the pulley assembly.

13. The crossbow as claimed in claim 12, wherein the idle wheel of each one of the two pulley assemblies has a cable tray being annular; and the cable of each one of the two pulley assemblies is mounted in the cable tray of the idle wheel of the pulley assembly.

14. The crossbow as claimed in claim 12, wherein the limb of each one of the two bow assemblies has two limb units; and a swinging shaft mounted through the two limb units and the bow mount to connect the limb and the bow mount.

15. The crossbow as claimed in claim 14, wherein the idle wheel of each one of the two pulley assemblies has a cable tray being annular; and the cable of each one of the two pulley assemblies is mounted in the cable tray of the idle wheel of the pulley assembly.

* * * * *